US008978172B2

(12) United States Patent
Plate et al.

(10) Patent No.: US 8,978,172 B2
(45) Date of Patent: Mar. 17, 2015

(54) PLUMBING FIXTURE HAVING MODULAR CONTROL HOUSING

(75) Inventors: Eric M. Plate, Plymouth, WI (US); Peter W. Denzin, Glenbeulah, WI (US); Joseph L. Stauber, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 1309 days.

(21) Appl. No.: 12/619,997

(22) Filed: Nov. 17, 2009

(65) Prior Publication Data

US 2011/0113540 A1 May 19, 2011

(51) Int. Cl.
*E03D 1/00* (2006.01)
*E03D 1/01* (2006.01)
*E03D 9/08* (2006.01)

(52) U.S. Cl.
CPC ... *E03D 1/01* (2013.01); *E03D 9/08* (2013.01)
USPC ..... 4/300

(58) Field of Classification Search
CPC ..... E03D 5/10
USPC ..... 4/300–442
See application file for complete search history.

(56) References Cited

U.S. PATENT DOCUMENTS

| | | | | |
|---|---|---|---|---|
| 1,625,950 | A | 4/1927 | Lee | |
| 1,957,831 | A | 5/1934 | Hague et al. | |
| 2,658,203 | A | 11/1953 | Aue | |
| 3,715,549 | A | 2/1973 | Kraff | |
| 3,932,901 | A | 1/1976 | Inui et al. | |
| 3,995,327 | A | 12/1976 | Hendrick | |
| 4,439,874 | A | 4/1984 | Schrock | |
| 5,036,443 | A | 7/1991 | Humble et al. | |
| 5,259,073 | A | 11/1993 | Tsutsui et al. | |
| 5,305,475 | A | 4/1994 | Jaeckels et al. | |
| 5,499,008 | A | 3/1996 | Rosenkrantz et al. | |
| 6,158,061 | A | 12/2000 | Cameron et al. | |
| 6,332,229 | B1 | 12/2001 | O'Malley et al. | |
| 6,782,561 | B2 | 8/2004 | Sigler et al. | |
| 7,380,292 | B1 * | 6/2008 | Harris | 4/213 |
| D594,945 | S | 6/2009 | Nakasaki et al. | |

(Continued)

FOREIGN PATENT DOCUMENTS

| | | |
|---|---|---|
| CN | 2585618 | 11/2003 |
| CN | 201116379 | 9/2008 |

(Continued)

OTHER PUBLICATIONS

One page of an ISR from the corresponding PCT/US2010/056472, mailed Feb. 16, 2011.

*Primary Examiner* — Lori Baker
(74) *Attorney, Agent, or Firm* — Foley & Lardner LLP

(57) ABSTRACT

A plumbing fixture, such as a bidet or toilet, includes a frontal basin and a supply of water for cleaning the basin. The plumbing fixture includes a modular housing mountable behind the basin and at least one control positioned in the modular housing to control operation of the plumbing fixture. The control may be light controls, bidet wand position controls, bidet wand heated air supply controls, bidet wand water supply controls, lid position movement controls, seat position movement controls, deodorizer controls, audio device controls and ultra violet sanitizer controls.

13 Claims, 9 Drawing Sheets

(56) References Cited

U.S. PATENT DOCUMENTS

| | | | | |
|---|---|---|---|---|
| 8,418,277 | B2 | 4/2013 | Okubo et al. | |
| 2005/0246828 | A1* | 11/2005 | Shirai et al. | 4/420.4 |
| 2006/0064810 | A1* | 3/2006 | Teranishi et al. | 4/420.4 |
| 2006/0070364 | A1* | 4/2006 | Reamsnyder et al. | 55/484 |
| 2006/0143814 | A1* | 7/2006 | Wang | 4/300 |
| 2007/0000039 | A1 | 1/2007 | Huei | |
| 2012/0174309 | A1* | 7/2012 | Kuang | 4/420.4 |
| 2012/0284912 | A1* | 11/2012 | Kuang | 4/443 |

FOREIGN PATENT DOCUMENTS

| | | | |
|---|---|---|---|
| DE | 2547496 | | 4/1997 |
| JP | 60-080171 | | 6/1985 |
| JP | 60098026 | * | 6/1985 |
| JP | 61-130672 | | 8/1986 |
| JP | 02-274930 | * | 11/1990 |
| JP | 2009-002033 | | 1/2009 |
| KR | 10-2009-0061625 | | 6/2009 |
| WO | WO2006/070364 | | 6/2006 |

* cited by examiner

PLUMBING FIXTURE HAVING MODULAR CONTROL HOUSING

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to plumbing fixtures such as toilets and bidets. In particular, the present invention relates to modular control housing systems where a given fixture can be readily customized for various electronic features depending on consumer preferences.

Conventionally, when a user purchases a toilet or the like, the item is ordered substantially as-is (except for perhaps some limited ability to select surface color). Hence, a particular model of a toilet or bidet often is ordered with a preselected array of standard control features. If a purchaser wishes a different array of control features, they may need to select a somewhat differently shaped fixture to obtain them. Further, there may be no model available from a particular manufacturer that has exactly the combination of control features most preferred by the purchaser, and no others.

Of course, a manufacturer could produce hundreds of stock keeping units representative of hundreds of possible control feature combinations. However, this would greatly increase inventory costs, and might lead to some combinations being produced that don't sell at all or don't sell well.

Hence, there is a need for improved plumbing fixtures that facilitate customizing control features, while minimizing problems of the above kind.

SUMMARY OF THE INVENTION

One aspect of the invention provides a plumbing fixture of the type having a frontal basin (e.g. a toilet or bidet), as well as means for directing a supply of water to the basin for cleaning the basin. The plumbing fixture includes a modular housing mountable behind the basin and at least one control positioned in the modular housing to control operation of the plumbing fixture. The control is selected from the group consisting of light controls, bidet wand position controls, bidet wand heated air supply controls, bidet wand water supply controls, lid position movement controls, seat position movement controls, deodorizer controls, and ultra violet sanitizer controls.

In one aspect the plumbing fixture is a bidet with a retractable bidet wand that extends from the modular housing to the basin. In another the plumbing fixture is a toilet or bidet with a seat and a lid attached to the modular housing. The modular housing houses a drive mechanism for raising and lowering the seat and the lid.

In yet another aspect the plumbing fixture includes a rearward extension from the basin that the modular housing is positioned under.

In still yet another aspect the plumbing fixture includes a deodorizer subject to a control positioned in the modular housing.

In some aspects one or more of the controls in the housing is an electrical control.

According to another aspect of the invention the modular housing includes a translucent wall and at least one light source that is positioned therein. Light source(s) may be selectively illuminated (e.g. to create a night or environmental light).

In still another aspect of the invention the modular housing also houses a control for an electrical audio device. The electrical audio device may include a remote control receiver.

Yet another plumbing fixture is disclosed of the type having a frontal basin and means for directing a supply of water to the basin for cleaning the basin. This plumbing fixture also includes a modular housing mountable behind the basin. A translucent wall forms a part of the modular housing. At least one light source is positioned in the modular housing and can be selectively illuminated to transmit light through the translucent wall.

In one aspect of this form of the invention at least one control is positioned in the modular housing to control operation of the plumbing fixture. This control is selected from the group consisting of light controls, bidet wand position controls, bidet wand heated air supply controls, bidet wand water supply controls, lid position movement controls, seat position movement controls, deodorizer controls and ultra violet sanitizer controls.

Hence, the invention provides a plumbing fixture that is customizable with respect to electronically controllable features. The manufacturer creates a standard front area of the fixture plus rearward extension (using a conventional molding process) so as to present the primary appearance visible to a consumer. When the consumer orders a particular selection of electronic controls "á la carte", a particular box of controls and features is assembled as a module, and then slid under the rear extension and behind the basin. The parts are then linked together.

If the consumer later wants a different grouping of control features, or there are maintenance problems with the electronics, the module can be replaced at much lower cost than replacing a full toilet or bidet. Optionally, if a consumer likes their selection of controls, but due to a remodel wants different frontal aesthetics, they can swap out the front, while keeping the rear module.

Further, this construction allows the rear housing to itself function as a unique night light, wholly apart from other control functions.

The foregoing and still other advantages of the invention will appear from the following description. In that description reference is made to the accompanying drawings which form a part hereof and in which there is shown by way of illustration preferred embodiments of the invention. These embodiments do not represent the full scope of the invention. Rather, the claims should be looked to in order to judge the full scope of the invention.

DETAILED DESCRIPTION OF THE INVENTION

Figure 1A:
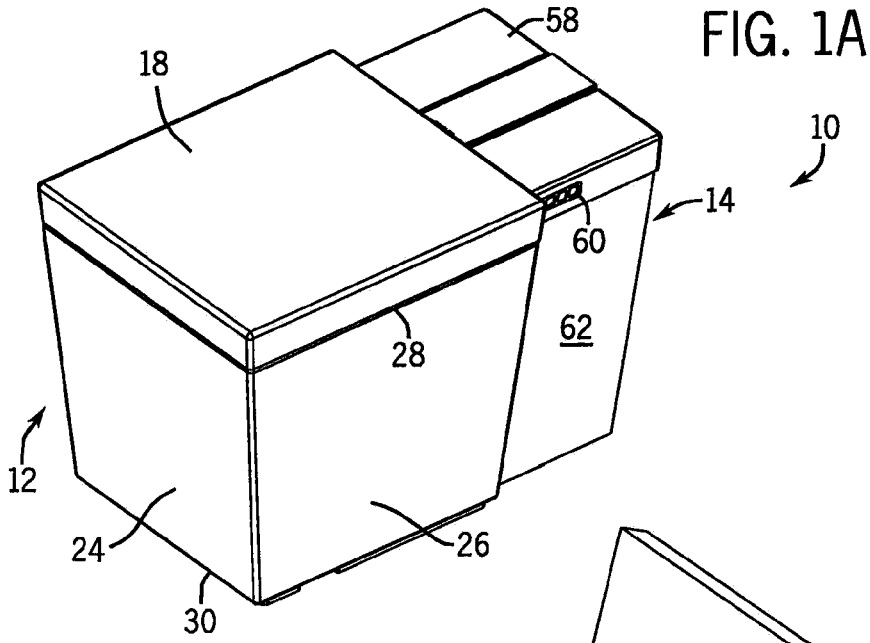
FIG. 1A is a perspective view of a plumbing fixture of the present invention with its lid down.
Figure 1B:
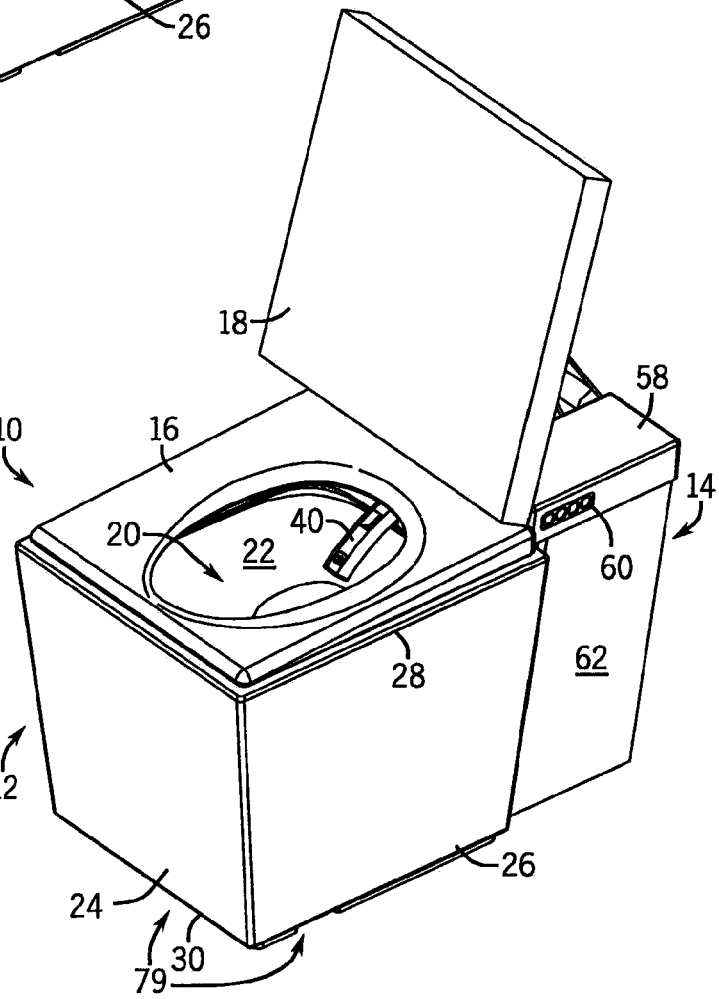
FIG. 1B is a perspective view of the plumbing fixture of FIG. 1A with its lid up.
Figure 2:
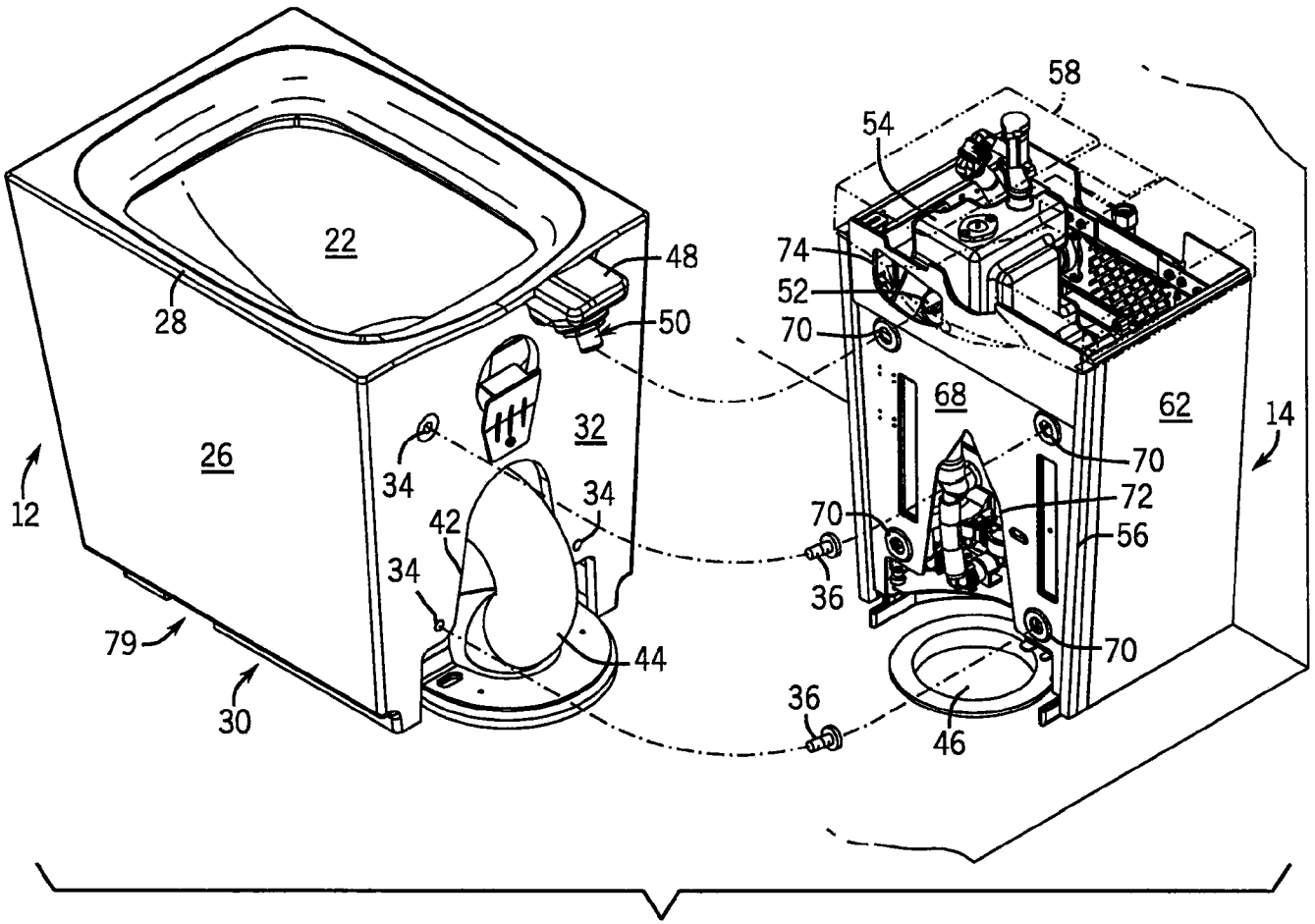
FIG. 2 is an exploded view of that plumbing fixture, with lid structure removed, showing the frontal basin structure separated from a modular housing.

Referring first to FIGS. 1A, 1B, and 2, a plumbing fixture in the form of a bidet 10 has a frontal basin 12 attached to a modular housing 14 (a "backpack"). The modular housing 14 has a seat 16 and a lid 18 attached thereto that may, subject to electronic or manual control, be raised or lowered to expose an opening 20 into a bowl 22 formed in the frontal basin 12.

The frontal basin 12 is contoured box-shaped and made from a conventional ceramic or vitreous material. Of course, the materials used in the frontal basin 12 may alternatively include other materials such as metal, plastic, or the like, or be combinations of various materials to provide the desired appearance.

As shown in FIGS. 1A and 1B, the frontal basin 12 includes exterior walls having a front face 24 and two lateral faces 26 which extend from an edge of a rim 28 towards a base 30 which contacts the floor.

As best seen in FIG. 2, the frontal basin 12 is mountable to a modular housing 14. A rear face 32 of the frontal basin 12 has a number of features formed therein or thereon to facilitate attachment of frontal basin 12 to the modular housing 14 and that accommodate the integration of the features of the modular housing 14 with the frontal basin 12. For example, the rear face 32 may include a number of holes 34 which receive bolts 36 or other fasteners that mechanically mount or connect the frontal basin 12 to the modular housing 14.

The rear face 32 also has a cutout area 42 through which a portion of a trapway 44 extends. The trapway 44 connects the bowl 22 to a sewer drain or the like for elimination of waste and water from the bowl 22 during the flush cycle. Given the limited space available around and behind the bidet 10, the trapway 44 curves past the rear face 32 of the frontal basin 12 and into the space of the modular housing 14 before connecting to a waste line at a hole 46 in the floor.

A rearwardly extending projection 48 with a male half of a spud connection 50 extends back from the rear face 32 for connection with a line 52 in communication with a water tank 54 in the modular housing 14.

The modular housing 14 includes a structural frame 56 that supports and/or contains a number of controls that control operation of the plumbing fixture as will be described in further detail below. The modular housing 14 has an upper cover 58 with buttons 60 on the side for operation of various features of the fixture, two lateral side walls 62, a rear wall 64 having a water connection pipe 66 extending therefrom for connection to a supply of water, and a front face 68 that is adapted for mounting to the rear face 32 of the frontal basin 12. Although an embodiment is shown in which the water connection pipe 66 extends from the rear wall 64 of the fixture, water could be supplied from another location such as from underneath the fixture.

The front face 68 of the modular housing 14 has connection features that generally correspond to the connection features of the rear face 32 of the frontal basin 12. For instance, the front face 68 of the modular housing 14 includes holes 70 which correspond to the locations of the holes 34 in the frontal basin 12 when the faces are placed against one another (although in some assemblies spacers may be located between the faces to prevent damage to frontal basin 12 and the modular housing 14 during fastening). Likewise, a cutout area 72 in the front face 68 of the modular housing 14 generally corresponds to the space in which the trapway 44 extends into the modular housing 14, thus saving space in the overall fixture as the trapway can extend backwards past the rear side of the frontal basin 12. A hole 74 is also formed in the front face 68 proximate the line 52 into which the rearwardly extending projection 48 may be inserted.

Figure 4:
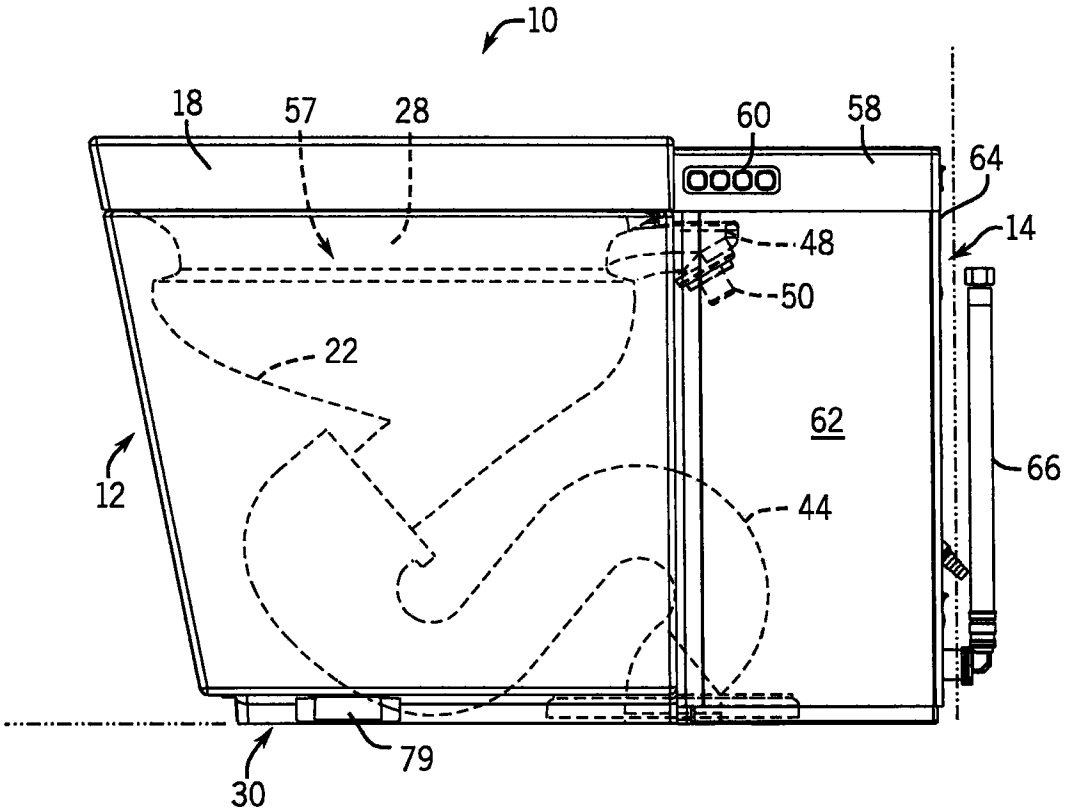
FIG. 4 is a side view of a plumbing fixture in which the spud connector, the bowl and the trapway are shown in phantom lines.
Figure 5A:
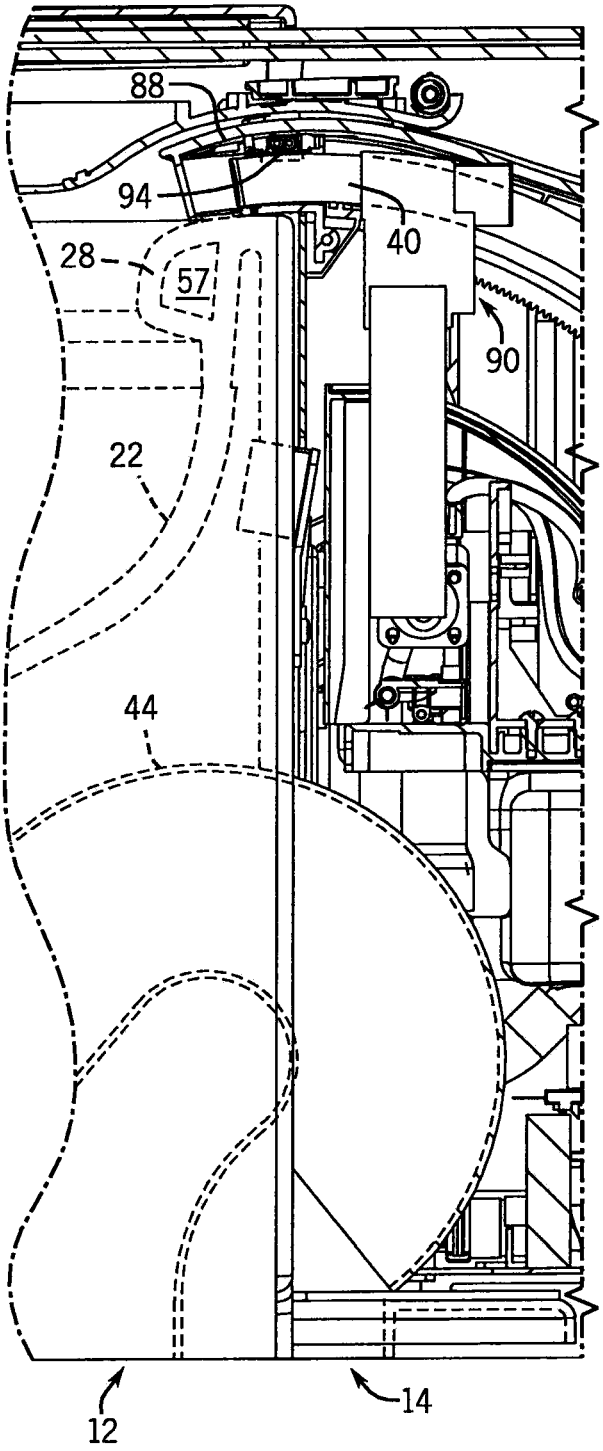
FIG. 5A is a cross-sectional side view of a retractable bidet wand used with this fixture, shown in a retracted position.
Figure 5B:
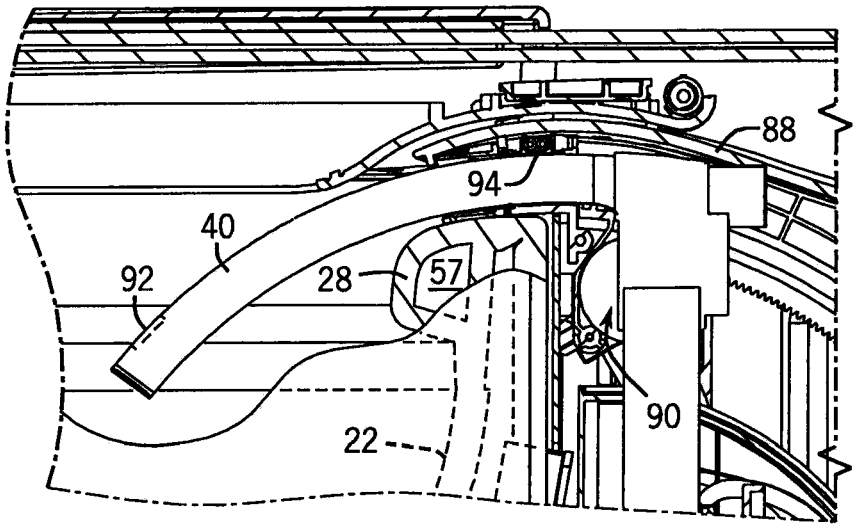
FIG. 5B is a view similar to FIG. 5A, but showing the retractable bidet wand in an extended position.
Figure 6:
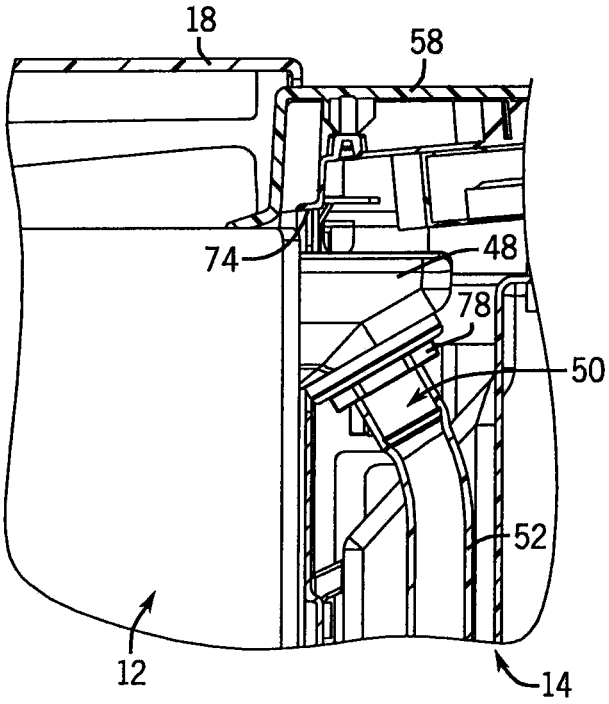
FIG. 6 is a detailed cross-sectional view of a spud connection between the frontal basin and the modular housing.

As best shown in FIG. 6, the rearwardly extending projection 48 with the male half of the spud connection 50 is inserted into the hole 74 (as best shown in FIG. 6) to form the spud connection. This spud connection places a supply of water, such as the tank 54 in the modular housing 14, in communication with a channel 57 in the rim 28 of the bowl 22 (as best seen in FIG. 4) to deliver water to the bowl 22 and to rinse the bowl 22 during the flush cycle. During assembly, the male end of the spud connection 50 is forced into the line 52, and upon tightening of a nut 78, a water-tight seal is formed along the coupling.

Thus, generally speaking, three types of connections may be formed between the modular housing 14 and the frontal basin 12: fastening connections, water connections, and electrical connections. Fastening connections physically secure the frontal basin 12 to the modular housing 14 using bolts, as in the form shown, or other such fasteners. The water connections supply the water for operation of the plumbing fixture to the frontal basin 12. In the form shown, the water connection is the spud connection which is particularly well adapted for dimensional variances introduced in the casting process of the frontal basin 12. Further, although not explicitly shown with wires, the modular housing 14 may include electrical connections which extend into the frontal basin 12 to provide, for example, electrical connections to proximity sensors 79 located near the base 30 of the frontal basin 12. In some instances, such as with a bulkhead, it may be inappropriate to extend certain types of connections forward and, in those instances, those types of connections may be avoided. Of course, it is contemplated that other types of connections could also be employed or other types of devices could be controlled through the connections. Gaskets, seals, and so forth may also be included as necessary in forming these connections to ensure the connections are formed correctly and without leakage (when applicable) and, further, to prevent damage to either the modular housing 14 or the frontal basin 12 from over-tightening at the connections.

Figure 3:
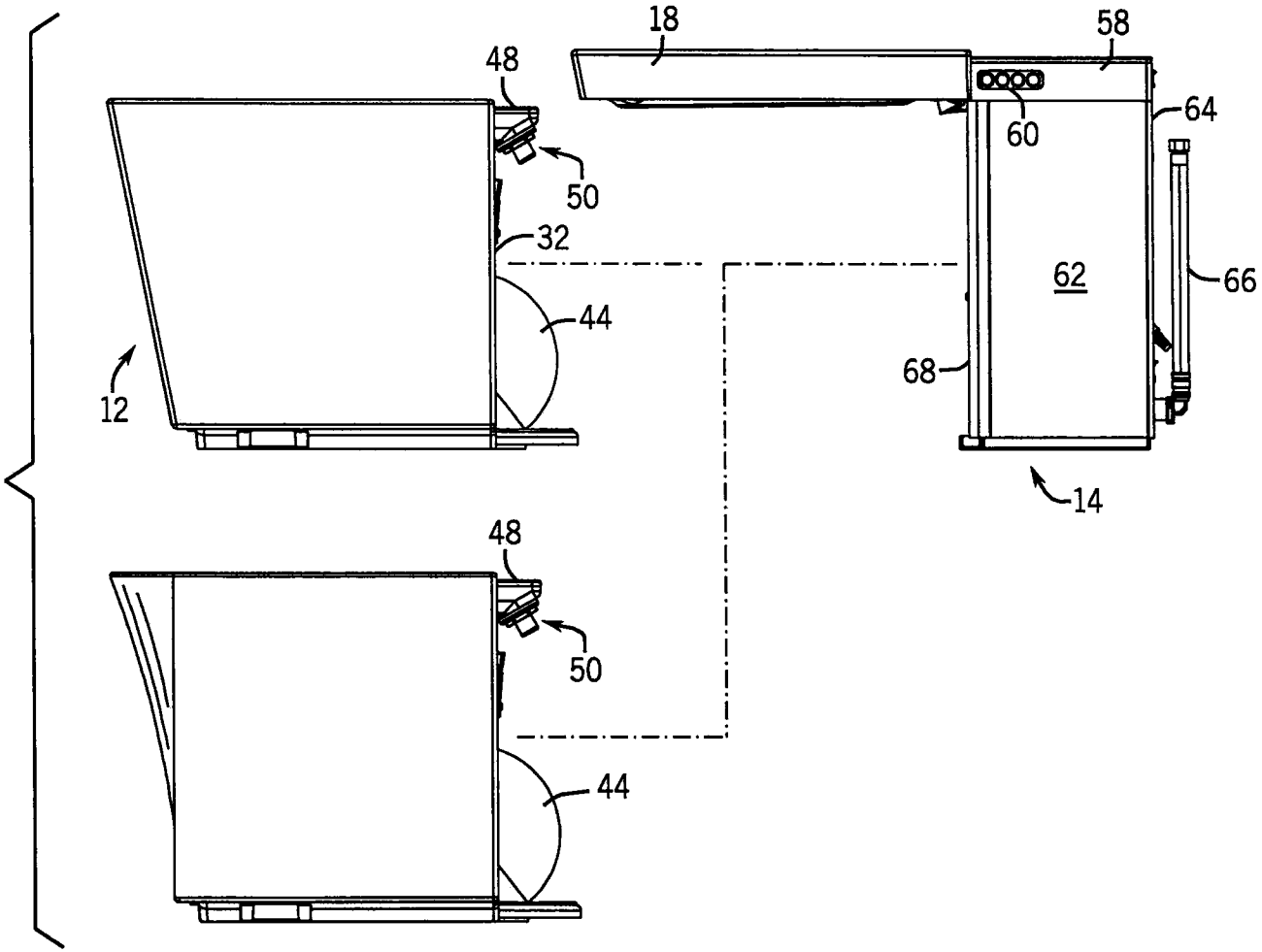
FIG. 3 is an exploded side view of the plumbing fixture of FIG. 1, further showing the application of an alternative frontal basin as an option.

It should be appreciated that the despite the highly interconnected nature of the modular housing 14 and the frontal basin 12, many of the operational components are primary supported by the modular housing 14. This essentially makes the frontal basin 12 a replaceable shroud. Hence, the modular housing 14 could receive any of a number of types of frontal basins adapted for connection to the modular housing 14. For example, referring now to FIG. 3, the frontal basin 12 of FIGS. 1-2 having a box-shaped appearance could be attached to the modular housing 14 or an alternative frontal basin 80 having a curved front face could be attached to the modular housing 14. Of course, frontal basins having other styles and shapes could also be attached, assuming that the frontal basins are properly adapted for connection to the modular housing 14. Moreover, even if a frontal basin is not perfectly adapted to the shape of the modular housing 14, the modular housing 14 could have easily modifiable features that conceal this mismatch. For example, if the frontal basin is oval-shaped, such that the rearward facing portion is curved and not square, then the lateral walls could be made to extend further forward to meet the frontal basin. These walls would shroud any areas which might otherwise reveal an imperfect match between the rear-attaching face of the front basin and the forward-attaching face of the modular housing.

Further, as the shape of the rim 28 and the opening 20 may change as the frontal basin is changed, the seat 16 and the lid 18 may be replaced to match the particular frontal basin design.

Of course, although the attachment of a rear face 32 of the frontal basin 12 and a front face 68 of the modular housing 14 are described, it should be appreciated that the manner in which the frontal basin 12 is attached to the modular housing 14 need not necessarily include faces which are coupled together along an attachment interface. Other types of connections having more open styles of connection in which no internal faces couple with one another may also be suitable for connection of the frontal basin 12 to the modular housing 14.

The modular housing 14 may contain a number of controls for the operation of the plumbing fixture. One advantage of the modular housing 14 is that a user may select controls for installation into the modular housing 14 to their liking. Thus, the user can have the controls installed for the features the user wants without having the controls for unwanted features. This allows for customization of the operable components of the modular housing 14 and further provides the option of adding or subtracting features at a later time (i.e., upgrading or downgrading a plumbing fixture). Thus, when a user wants to add a feature that the plumbing fixture does not currently have, this does not require either the complete replacement of the fixture or the often awkward and unsightly addition of an external device.

Figure 7:
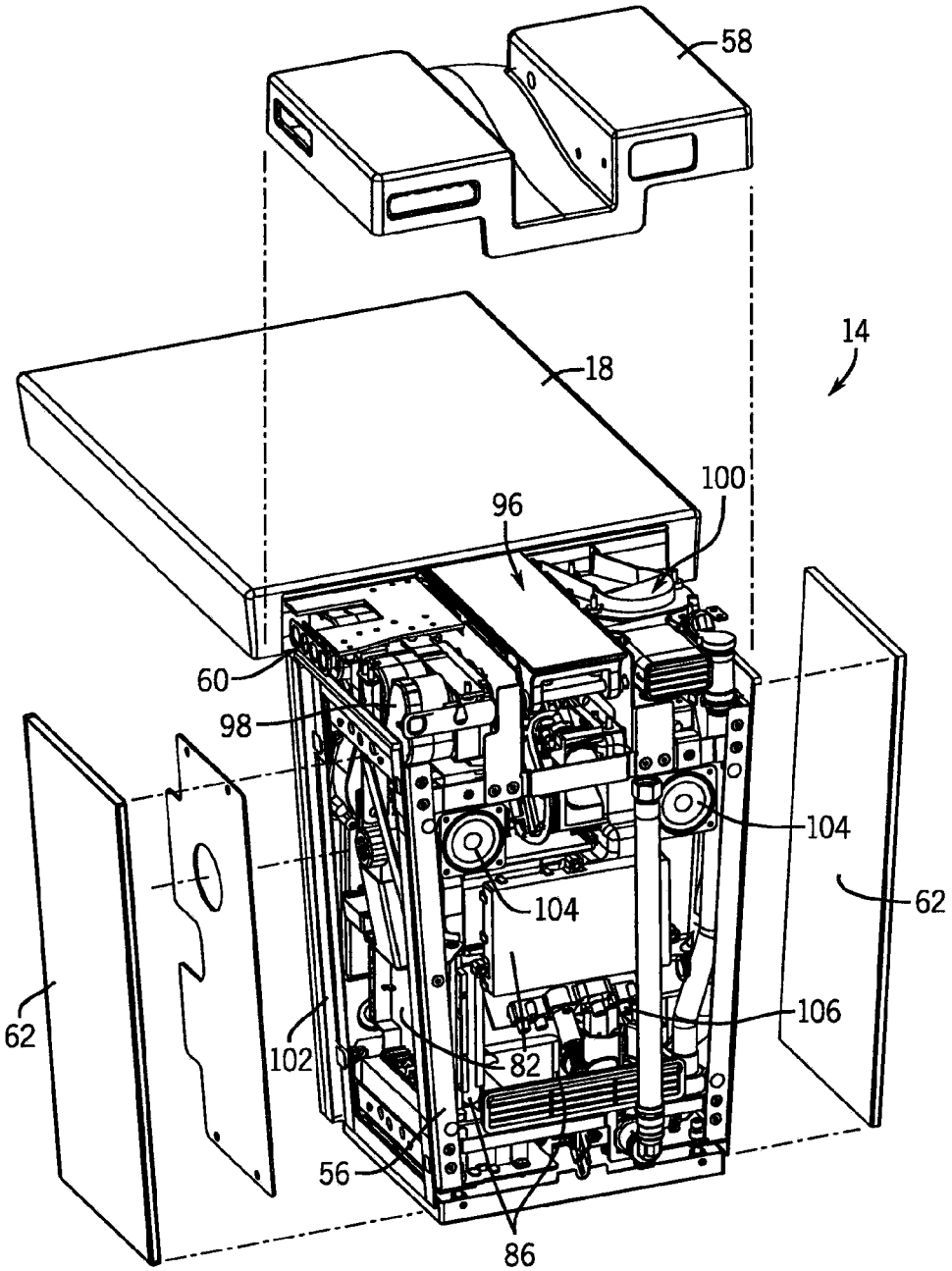
FIG. 7 is a top rear right side perspective view of a modular housing which is partially exploded.

Some controls in the modular housing may include, but are not limited to, light controls, bidet wand position controls, bidet wand heated air supply controls, bidet wands water supply controls, seat and/or lid position movement controls, deodorizer controls and/or ultraviolet sanitizer controls. The modular housing 14 may also include a control for an electrical audio device such as a CD player or integrated television. The modular housing 14 may be adapted for connection to the internet and/or a home network either with a wired connection or wirelessly to transmit and/or receive information to be used with one or more of the controls. Further, the modular housing may have a remote control receiver unit that receives input from a remote control to operate one or more of the controls. As shown in FIG. 7, one or more controllers 82 or printed circuit boards may be electrically connected to these various features to control their operation. The controller 82 may receive power via an electrical plug (not shown) or via one or more backup power battery packs 86 contained within the modular housing 14.

Referring now to FIGS. 5A, 5B, 9, and 10, the operation of a retractable bidet wand 40 is shown. The retractable bidet wand 40 may be operated via the buttons 60 or the like which instruct the controller 82 to send information to the bidet assembly to perform a particular action. The retractable bidet wand 40 is contained within a storage sheath 88 when not in use. When the controller 82 instructs the bidet wand 40 to extend by operation of position controls, a drive mechanism 90 actuates the extension of the bidet wand 40 out of the storage sheath 88, over the rim 28 and into the bowl 22 in a location that corresponds to a location a user may desire to use the bidet wand 40 for cleaning. Of course, the bidet wand 40 could have another path of extension in which the bidet wand 40 is extendable through a portion of the rim 28 and/or the bowl 22. The user may then use the buttons 60 or the like to effectuate a stream of water from a head 92 of the bidet wand 40 or a flow of heated air from an opening 93 from a duct of the bidet wand 40 using the respective associated controls. The user may then use the buttons 60 or the like to actuate the bidet wand 40 back into the storage sheath 88 when use is complete.

Figure 9:
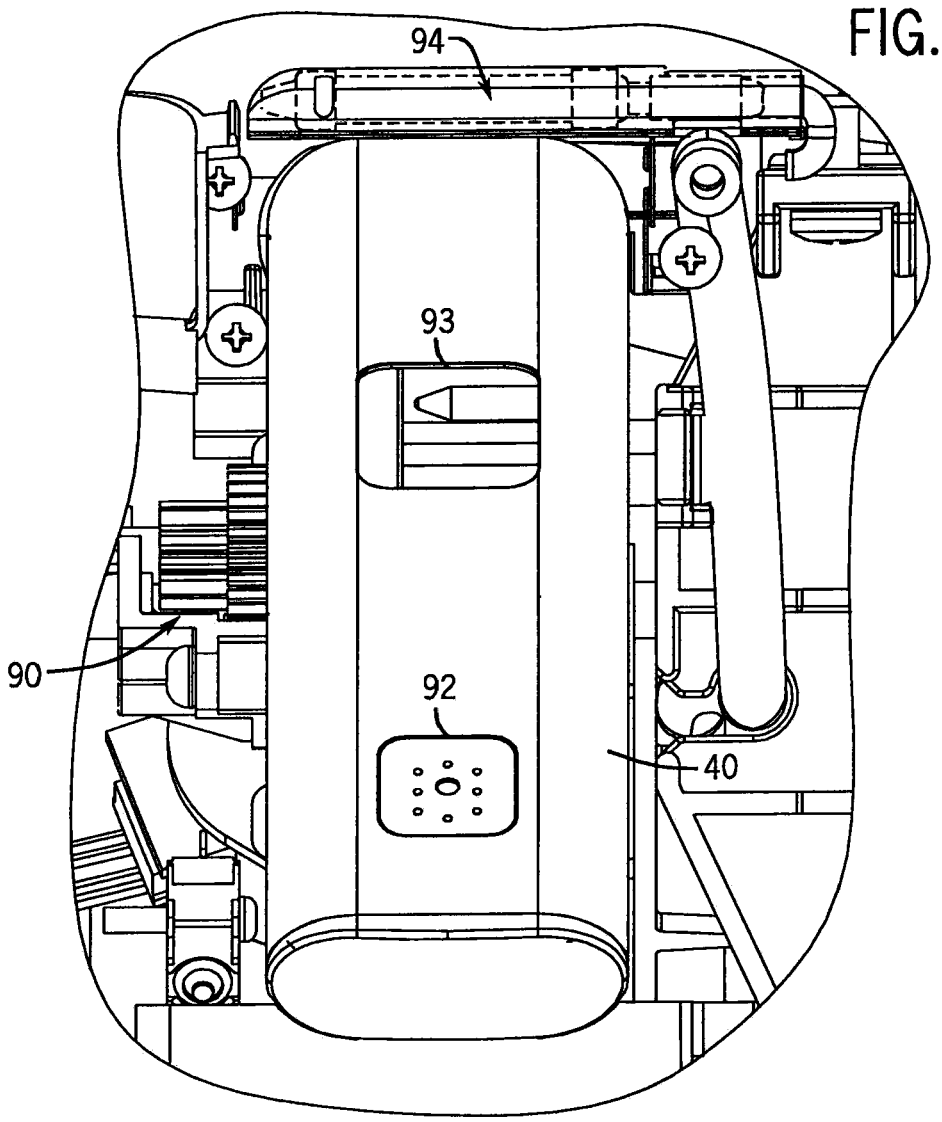
FIG. 9 is a front plan view of the bidet wand control area of FIG. 5B.
Figure 10:
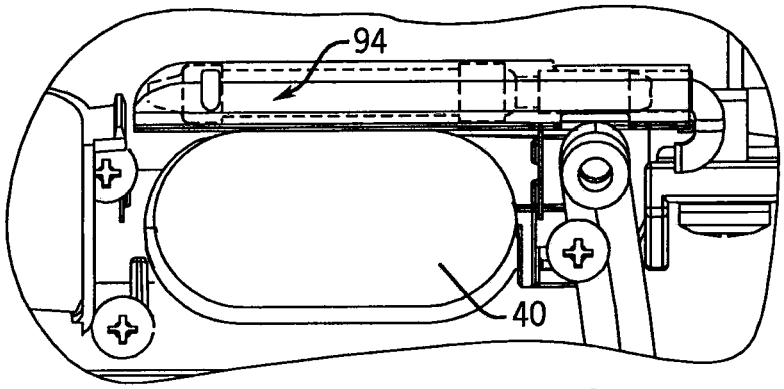
FIG. 10 is a front plan view of the bidet wand control area of FIG. 5A.

A separate control may be provided for operation an ultraviolet sanitizing light 94. As best shown in FIGS. 9 and 10, the ultraviolet sanitizing light 94 resides in a location that generally corresponds to the location of the water-emitting head 92 of the bidet wand 40 when the bidet wand 40 is retracted. The ultraviolet sanitizing light 94 may be operated using one of the buttons 60 or automatically timed to direct the controller 82 to power the ultraviolet sanitizing light 94, thus sanitizing the head 92 before or after use of the bidet wand 40 or at a specified time interval (i.e., every night at 2 A.M.). Alternatively, the controller 82 may be programmed such that the ultraviolet sanitizing light 94 performs the sanitizing operation immediately after or before use of the bidet wand 40 without separate action on the part of the user.

Referring to FIG. 7, the upper portion of the modular housing 14 supports the lid 18 and the seat 16 movement features. The lid 18 and the seat 16 are attached to a linkage assembly 96, the movement of which is driven by a driving mechanism 98 comprising one or more motors and gear boxes which are typically concealed by the upper cover 58 of the modular housing 14. Upon an initiating event (in some forms the event may be the activation via proximity sensors 79 or the like at the base 30 of the frontal basin 12, but it could also be a button press of one of the buttons 60 or initiated by the user starting to lift the seat 16 or the lid 18 with the motor taking over), the controller 82 directs the lid 18 and/or the seat 16 to be raised or lowered by starting the driving mechanism 98 to operate the linkage assembly 96.

Figure 8:
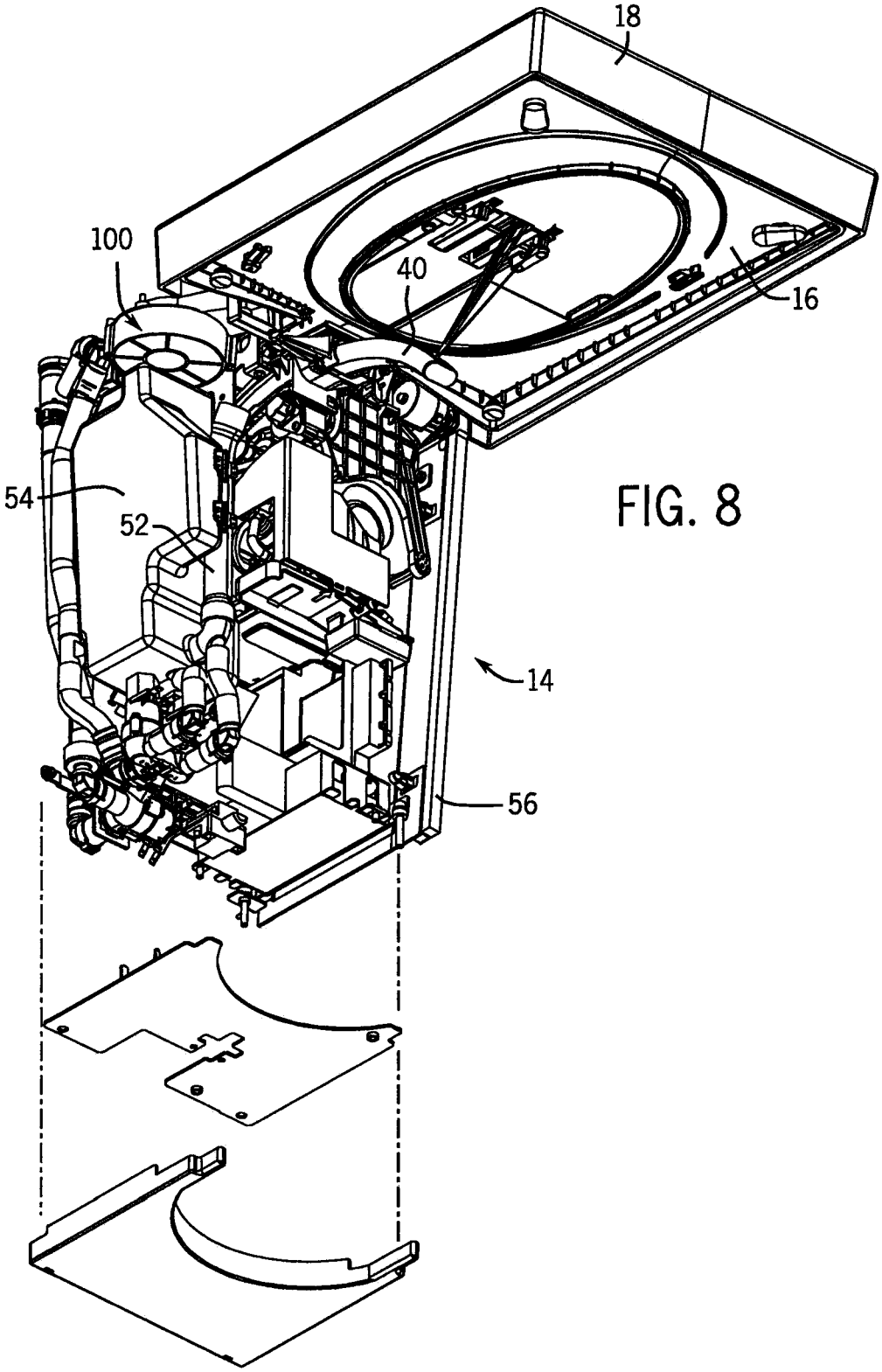
FIG. 8 is a bottom front left side perspective view of the modular housing which is partially exploded.

As best seen in FIGS. 7 and 8, a deodorizer 100 is also contained within the upper cover of the modular housing 14. Such a deodorizer 100 may blow air and/or a freshening agent into the region of the bowl 22 via air ducts using a fan to eliminate odor or, alternatively, may suck up air in the vicinity of the bowl 22 to capture and filter the air or blow the air back out of the bowl 22. Again, operation of the deodorizer 100 may be controlled using one or more controllers 82 and may occur when the controller(s) 82 receive an input signal or instruction to independently activate the deodorizer 100 or may be a part of a sequence of events (i.e., the lid 18 is raised and the deodorizer 100 is activated).

Still referring to FIG. 7, the modular housing 14 may also contain a light control. In the form shown, each of the lateral walls 62 may be composed of a translucent material so that an light source, such as an LED light strip 102, which is located along a peripheral edge of the lateral wall 62, may selectively illuminate the panel. The light source could be placed in other locations as well such as along any other edge, or behind the lateral wall 62 to back light the lateral wall 62. The light control may be user operated via the operation of buttons 60 or the like, could be set to operate at certain times of the day, or be activated upon the detection of an individual in the area around the fixture using one of the proximity sensors 79 or the like. When the controller 82 determines that the LED light strip 102 should be illuminated according to one of these conditions, then the controller 82 directs the necessary power to the LED light strip 102 to illuminate the panel. Among other things, this illumination provides a nightlight-type feature which helps the user to see the area around the plumbing fixture.

It should be appreciated that in some forms the lateral walls 62 may be removable such that different styles of panels could be inserted into the side for illumination. It is contemplated that different colors, adjustable colors, patterns, or artistic renderings could be placed on these panels to customize the fixture to the liking of the user or to match the surrounding aesthetic. The removable nature of the lateral walls 62 also means that the lateral walls 62 could be used as service panels to provide accessibility to the internal components in the modular housing 14.

As best seen in FIG. 7, electrical audio controls are also provided in the modular housing 14. In particular, a pair of speakers 104 are mounted to the rear side of the frame 56. These speakers 104 are connected to one or more of the controllers 82 which may also have audio connections 106 for the reception of an audio signal or for outputting the audio signal to separate external speakers. Again, it is contemplated that the operation of the audio control could have integrated control via buttons 60 or the like or may have a remote which wirelessly operates the controller 82 via a wireless module or the like. Alternatively, a wired control may be attached at one of the audio connections 106 at the rear of the modular housing 14.

The controls for other operations may also be housed in the modular housing 14, but extend into the frontal basin 12. For instance, front and side proximity sensors 79 for various operations of the toilet may be contained at the base 30 of the frontal basin 12, and may be in electrical communication with one or more controllers 82 contained within the modular housing 14. Likewise, air heated in the modular housing 14 may be blown forward toward the base of the frontal basin 12 (using ductwork or by limiting the flow path of air) to heat the area around the base 30 of the frontal basin 12 to warm the feet of a user using the plumbing fixture. Also the trapway 44 and/or gear box(es) may be part of, or located in, the modular housing 14.

Hence, a plumbing fixture is provided that is modular and very customizable. By incorporating a modular design, a user can select á la carte all of the features the user wants in the plumbing fixture, but not have to pay for features that are unwanted. Further, the plumbing fixture may be upgraded over the life of the fixture without upsetting the aesthetic of the fixture. Any new additions can be installed into the modular housing and integrated into the front basin as required.

Additionally, the modular design allows for the replacement of the front basin without discarding the components in the modular housing. Thus, if the front basin is damaged or if the user decides a front basin having a different appearance is more desirable (and which has a form acceptable for attachment to the modular housing), this basin change can be easily made.

While a specific embodiment of the present invention has been shown, various modifications falling within the breadth and scope of the invention will be apparent to one skilled in the art. For example, one or more of the separate features could be removed from the modular housing. Alternatively, features not described herein could be included in the modular design.

Thus, the following claims should be looked to in order to understand the full scope of the invention.

INDUSTRIAL APPLICABILITY

Disclosed is a plumbing fixture having a modular housing for improving the customization of the fixture.

What is claimed is:

1. A plumbing fixture, comprising:

a frontal basin assembly; and a module mountable behind the frontal basin assembly;

wherein the module includes a structural frame, a tank configured to hold water to be supplied for cleaning the basin, at least one electronic controller for controlling an operation other than supplying water for cleaning the basin, and one or more walls; and wherein the tank, the at least one electronic controller, and the one or more walls are coupled to the structural frame;

wherein the tank and the at least one electronic controller are located between the one or more walls; and wherein the at least one electronic controller is not disposed in the tank.

2. The plumbing fixture of claim 1, wherein the module includes a retractable bidet wand that extends from the module to the basin, the bidet wand is obscured from view by the cover; and the at least one electronic controller is configured to control the retractable bidet wand.

3. The plumbing fixture of claim 1, wherein the plumbing fixture is selected from the group consisting of toilets and bidets, the module includes a motor for moving a seat or lid, the motor is obscured from view by the cover, and the at least one electronic controller is configured to control the motor for movement of the seat or lid.

4. A plumbing fixture of a type having a frontal basin assembly having a basin and means for directing a supply of water to the basin for cleaning the basin, the plumbing fixture further comprising:

a module mountable behind the frontal basin assembly; and a rearward extension from the frontal basin assembly that the module is positioned under;

wherein the module includes a tank configured to hold water to be supplied for cleaning the basin, at least one electronic controller for controlling an operation other than supplying water for cleaning the basin, and a cover; and wherein the tank and the at least one electronic controller are simultaneously completely obscured from view by the cover, and the at least one electronic controller is not disposed in the tank.

5. The plumbing fixture of claim 1, wherein the module includes a deodorizer configured to blow gas into or suck gas out of the basin, the deodorizer is obscured from view by the cover, and the at least one electronic controller is configured to control the deodorizer.

6. A plumbing fixture of a type having a frontal basin assembly having a basin and means for directing a supply of water to the basin for cleaning the basin, the plumbing fixture further comprising:

a module mountable behind the frontal basin assembly;

wherein the module includes a tank configured to hold water to be supplied for cleaning the basin, at least one electronic controller for controlling an operation other than supplying water for cleaning the basin, and a cover;

wherein the tank and the at least one electronic controller are obscured from view by the cover, and the at least one electronic controller is not disposed in the tank; and wherein the cover of the module includes a translucent wall and at least one light source is positioned therebehind, and the at least one electronic controller is configured to control the at least one light source.

7. The plumbing fixture of claim 1, wherein the module includes an electrical audio device, and the at least one electronic controller is configured to control the electrical audio device.

8. A plumbing fixture of a type having a frontal basin and means for directing a supply of water to the basin for cleaning the basin, the plumbing fixture further comprising:

a modular housing mountable behind the basin;

a translucent wall forming a part of the modular housing; and at least one light source is positioned in the modular housing at a height below an uppermost portion of the basin;

wherein the at least one light source can be selectively illuminated to transmit light through the translucent wall.

9. The plumbing fixture of claim 8, wherein at least one control is positioned in the modular housing to control operation of the plumbing fixture, the control being selected from the group consisting of light controls, bidet wand position controls, bidet wand heated air supply controls, bidet wand water supply controls, lid position movement controls, seat position movement controls, deodorizer controls and ultra violet sanitizer controls.

10. The plumbing fixture of claim 1, wherein the one or more walls include at least two upright walls that are opposed to each other, and the tank and the electronic controller are located between the two upright walls.

11. The plumbing fixture of claim 10, wherein the one or more walls further includes an upper wall, and the tank and the electronic controller are located below the upper wall when the plumbing fixture is mounted to a floor.

12. The plumbing fixture of claim 1, wherein at least a portion of the one or more walls is translucent.

13. The plumbing fixture of claim 4, wherein the module further comprises a structural frame, and wherein the tank, the at least one electronic controller, and the cover are coupled to the structural frame.

* * * * *